United States Patent [19]

Regler et al.

[11] 4,187,827

[45] Feb. 12, 1980

[54] PROCESS FOR MULTIPLE LAP CUTTING OF SOLID MATERIALS

[75] Inventors: Dieter Regler, Burghausen; Erhard Sitrl, Marktl; Alfred Moritz, Burghausen, all of Fed. Rep. of Germany

[73] Assignee: Wacker-Chemitronic fur Elektronic Grundstoffe mbH, Burghausen, Fed. Rep. of Germany

[21] Appl. No.: 902,514

[22] Filed: May 3, 1978

[30] Foreign Application Priority Data

May 20, 1977 [DE] Fed. Rep. of Germany ..... 2722782

[51] Int. Cl.[2] ..... B28D 1/02

[52] U.S. Cl. ..... 125/16 R; 51/283 R

[58] Field of Search ..... 125/12, 16 R, 21; 51/283 R

[56] References Cited

U.S. PATENT DOCUMENTS

| | | | |
|---|---|---|---|
| 2,830,573 | 4/1958 | Wallin | 125/16 R |
| 3,032,026 | 5/1962 | Raabe | 125/21 |
| 3,957,028 | 5/1976 | Lesiourd | 125/16 R |

OTHER PUBLICATIONS

J. Phys. E (G.B.), vol. 4, pp. 54–56 dated Jan. 1971, articles by C. S. Dickinson.

*Primary Examiner*—Harold D. Whitehead

*Attorney, Agent, or Firm*—Allison C. Collard; Thomas M. Galgano

[57] ABSTRACT

A process for the multiple lap cutting of solid materials, using a set of parallel, spaced apart blades mounted on the frame of a gang-saw for reciprocal movement over the solid materials to be cut, in a suspension of a lapping abrasive, wherein a pressure of from 100 to 1,000 gf per blade is exerted on the solid material, the free working length of the blades is held between 110 to 250 mm, and wherein the pressure applied to the blades is inversely proportional to the length of the blades, and the blades move through the solid material at a mean lateral speed of from 30 to 150 meters per minute.

4 Claims, No Drawings

PROCESS FOR MULTIPLE LAP CUTTING OF SOLID MATERIALS

The invention relates to a process for the multiple lap cutting of solid materials, in which a set of blades is passed at a specific pressure by means of a lateral forward and backward movement, in a suspension of a suitable lapping abrasive, through the solid material to be cut.

Semiconductor rods of silicon or germanium, for example, are frequently cut with saws. The circular saw blade is made, for example, of nickel or steel, and is usually checked and the cut is effected at the edge. However, these saw blades have to be relatively thick, in order to have the required stability and to ensure a straight cut. Thus, the cutting losses of semiconductor material as a result of using these blades are therefore fairly high.

When saws are used having inner holes, in which the saw blade is chucked at its periphery and has at its center a hole of a few centimeters diameter that is studded with diamond particles and serves as the cutting edge, thinner saw blades may be used, so that the losses of material as a result of cutting are lower.

Both types of saws, however, have several disadvantages. The most serious of these is microsplitting, such as microcracks in particular, which means damage to the crystal. This damage, in an extreme case, passes through the entire crystal and can, therefore, no longer be eliminated, even by by subsequent operating steps, such as etching or lapping.

A further disadvantage is the irregular damage to the surface layer that frequently occurs during sawing and which cannot be eliminated by etching alone. It can only be eliminated by removing a comparatively thick surface layer. Further disadvantages are that the discs cut from the rod using saws of this kind frequently exhibit a certain bowing, i.e., they are not completely flat and uniformly thick, which causes faults when the discs are further processed, to form components.

The disadvantage of the high losses of material stemming from the saw cut can be lessened by using conventional band saws having straight saw blades, as the cutting speed of such saws is considerably less, and thus, the width of the cutting groove is smaller than when circular saws are used. By combining several saw blades to form a gang, the disadvantage of the cutting efficiency, which is less per unit of time, may be correspondingly reduced. In contrast to the gang saws having shaped saw blades used in the timber industry, and the conventional gang-saws for stone working, which have a cutting substance bonded to the blade, smooth steel blades are normally used for the gang sawing of, for example, oxidic materials, such as sapphire or ruby, and semiconductor materials, such as silicon or germanium. The blades convey with them an abrasive, such as diamond powder, for example, which is suspended in a coolant. A gang-saw of this kind is described, for example, in German Patent Specification No. 20 39 699. The advantage of these saws lies not only in the uniform damage to the surface of the cutting face, which can be eliminated by etching away a thin surface layer, but also in the fact that almost all discs are "bow-free," that is, are uniformly flat and do not bow.

To manufacture silicon solar cells suitable for use in industry, where the solar cells are needed as substitutes for other energy sources, such as fossil fuels, there is an urgent need not only to inexpensively make the base material, silicon, in the required purity, but to make the processing, especially the sawing of silicon rods or blocks, considerably less expensive. However, the use of conventional gangsawing processes, even with 240 blades in the gang, still requires double the sawing time per disc, compared with saws having inner holes; and is not advantageous in this form, despite its undisputed advantages compared with the other sawing processes described.

It is an object of the present invention to find a sawing process which provides a considerable increase in the yield of sawn platelets per unit of time.

This object is achieved by a multiple lap cutting process, which is characterized by the combination of the following features:

(a) a pressure (force) of from 100 to 1,000 gf (gram-force) per blade being exerted on the set of blades;

(b) the free working length of the blades lies within a range of from 110 to 250 mm, wherein the shorter the blades are made, the higher the pressure that can be exerted on them; and (c) the set of blades is moved at a mean lateral speed of from 30 to 150 meters per minute through the solid material to be cut.

Gang-saws or lap cutting machines, as described in German Specification No. 20 39 699 already mentioned, may be used for the process, according to the present invention, after the necessary modifications have been made.

In order to provide the required pressure of from 100 to 1,000 gf, preferably from 100 to 400 gf per blade, according to the instant invention, it is necessary that the free working length of the conventional blades be considerably shortened, to approximately 110 to 250 mm, and preferably to 180 to 220 mm, by suitable adjustments to the frame on which the blades are clamped. The shorter the blades within the given range, the higher will be the pressures exerted thereon, to avoid the blades distorting. Suitable materials for the blades are, in particular, grades of steel which may be obtained at a reasonable price, such as spring band steel, having a tensile strength of approximately 120 to 250 kgf/mm$^2$, preferably, from 200 to 240 kgf/mm$^2$, as the set of blades is normally thrown away after being used once. The reason for this is that the steel band essentially serves merely to guide the actual cutting implement, such as, a diamond particle, which, accordingly, leads not only to abrasion of the solid material to be sawn, but also to abrasion of the relatively soft steel band. The free working length of the blades is defined as that portion of the blades that is freely tensioned between the mountings. The depth of the blades is advantageously approximately 5 to 10 mm and, preferably, approximately 5 to 7 mm, with a width of approximately 100 to 300$\mu$. With regard to the blade width, it is expedient always to try to select values that are as low as possible, conveniently approximately 150 to 250 $\mu$m, in order to limit the losses resulting from cutting. Only when comparatively long blades are used, with the action of pressures in the upper part of the specified range, are relatively thick blades necessary. Advantageously, this will, however, be avoided, by using short blades within the range which has been specified as preferable.

The number of blades in the set of blades, the blades being separated by spacer discs, is not limited by the process and is, advantageously, as high as possible, since the yield of sawn discs then rises linearly with the number of blades. A natural limitation on the number of blades is imposed by the length of the work piece to be cut.

The pressure that is exerted on the frame in which the set of blades is tensioned, specified above as the pressure that acts per blade, is generally only fully brought to bear when all the blades of the set are biting into the rod, i.e., when all the blades of the set of blades have been brought into contact with the surface of the work piece to be cut, in a manner causing abrasion. If the full pressure were allowed to act on the frame prior to this, this would mean, particularly in the case of work pieces having irregularities in their surface structure, that the total pressure acting on the clamping frame would be effective only on some of the blades, namely, on those blades in contact with the work piece, and would thus be higher than desirable. These excessive pressure forces could then result in distortion or even breaking of these blades in the set of blades.

The mean lateral speed of approximately 27 m/minute, which is the speed customarily used at the present time, is increased to approximately 30 to 150 m/minute, preferably, to 90 to 120 m/minute, which is the speed according to the present invention. This increase can be achieved by increasing the frequency with which the set of blades moves backward and foward in an oscillating manner through the work piece to be sawn. The lateral speed is additionally determined by the length of the blades and the maximum diameter of the material in the direction of cutting, and in simple terms, corresponds to the formula:

$$V = \frac{(l - e)}{2} \cdot \nu \cdot \text{factor}$$

wherein l is the length of the blade, "e" is the maximum diameter of the material and $\nu$ is the frequency. It was found that with a lateral speed of slightly more than 150 m/minute, the abrasion drops abruptly to almost zero, an effect similar to the effect familiar to motorists as aquaplaning.

At frequencies of up to approximately 20 Hz, the conventional crank drives having a connecting rod moved by means of a crank disc, which are normally installed in gang saws, are suitable as the drive mechanism for the set of blades. When higher frequencies are used and associated higher lateral speeds of the set of blades of more than 90 m/minute, such drive mechanisms are no longer suitable because of the enormous acceleration forces. Here, drive mechanisms operating by means of linear motors or, particularly advantageously, by means of hydropulse drives, such as those manufactured by the firm of Schenck in Dramstadt, in which, generally speaking, the acceleration and braking forces occurring, are controlled by an oil pressure cylinder or, alternatively, drive mechanisms on an electromagnetic basis.

The conventional agents used with wire saws or gang saws may be used as lapping abrasive, for example, corundum powder, silicon carbide, boron carbide, cubic boron nitride or diamond powder, the hardness and thus the service life increasing in the sequence given. These substances are preferably used with a particle size of from 10 to 50 μm, suspended in an oil, for example, a mineral oil fraction having an average viscosity of from 30 to 60 cP. The weight ratio of the cutting particles to oil is approximately 1:10 to 1:3 in this case.

The cutting particles are selected according to the type of solid material to be cut. Thus, sapphire or spinel, for example, can be cut economically only with diamond or cubic boron nitride.

The process according to the present invention is especially advantageous for sawing semiconductor materials, such as silicon, germanium, III–V compounds, such as gallium arsenide and gallium phosphide, oxidic substances, such as sapphire, spinel and ruby or, alternatively, soft substances, such as hexagonal boron nitride, for example.

According to the process of the instant invention, cutting efficiencies exceeding by many times those of all known processes may be obtained.

Comparative Example

A monocrystalline silicon rod having the dimensions 50×50×220 mm was sawn, transversely to the longitudinal axis, into discs, using a gang-saw manufactured by the firm of Meyer & Burger AG, Steffisburg, Switzerland, type GS 1. A set of 240 blades were used, each having a thickness of 200 μm, a depth of 6 mm and a free working length of 355 mm. After the blades were placed on the silicon rod, the blades were moved over the crystal in the usual manner, at a low lateral speed of initially a few meters per minute, almost without pressure. Only after all blades had started to bite into the silicon rod was the lateral speed, with which the set of blades was passed through the silicon rod to be cut, increased to 27 m/minute. During the sawing, a pressure of 60 gf per blade was exerted on the set of blades. Silicon carbide, having a particle size distribution of from 27 to 30 μm and suspended in a mineral oil fraction having a viscosity of 45 cP, was used as the lapping abrasive, three parts by weight of mineral oil being added per part by weight of silicon carbide.

After a total sawing time of 24.5 hours, 239 discs, having a thickness of 470 μm were obtained. This corresponded to a sawing efficiency of 0.017 $cm^2$ per minute per blade.

Example

A monocrystalline silicon rod having the dimensions 50×50×220 mm was cut, using a lap cutting machine, which corresponded substantially to the gang-saw mentioned in the comparative example but which, however, was so adapted that it was possible to move shorter blades at a higher speed and at a greater pressure. In this case also, the rod was sawn into discs transversely to the longitudinal axis.

The set of blades again consisted of 240 blades having a thickness of 200 μm and a depth of 6 mm, but having a free working length of 200 mm. After placing the blades on the silicon rod, the blades were again passed over the crystal in the usual manner, at a low lateral speed of initially a few meters per minute, likewise almost without pressure. Only after all of the blades had started to bite into the silicon rod, was the lateral speed, with which the blades were passed through the silicon rod to be cut, increased to 45 m/minute. A pressure of 180 gf per blade was exerted on the set of blades during the sawing. As in the comparative example, silicon carbide in a mineral oil fraction, having a viscosity of 45 cP, in a weight ratio of three parts of mineral oil to one part of silicon carbide, was used as the lap cutting abrasive.

After a total sawing time of 2.6 hours, 239 discs of 470 μm thickness were obtained. This corresponded to a cutting efficiency of 0.16 $cm^2$ per minute per blade.

While several embodiments of the present invention have been shown and described, it will be obvious to those persons of ordinary skill in the art, that many changes and modifications may be made thereunto, without departing from the spirit and scope of the invention.

What is claimed is:

1. A process for the multiple lap cutting of solid semiconductor materials, using a set of parallel, spaced apart blades mounted on the frame of a gang-saw for reciprocal movement over the solid materials to be cut, in a suspension of a lapping abrasive, comprising the steps of exerting a force of from 100 to 1000 gf per blade on the solid material;

maintaining the free working length of the blades between 110 to 250 mm, wherein the force applied to the blades is inversely proportional to the length of the blades; and moving said blades through the solid material at a mean lateral speed of from 30 to 150 meters per minute.

2. The process according to claim 1, wherein a force of from 100 to 400 gf per blade is exerted on the set of blades.

3. The process according to claim 1, wherein said blades have a free working length of from 180 to 220 mm.

4. The process according to claim 1, wherein the set of blades is passed at a mean lateral speed of from 90 to 120 meters per minute through the solid material to be cut.

* * * * *

UNITED STATES PATENT AND TRADEMARK OFFICE

CERTIFICATE OF CORRECTION

PATENT NO. : 4,187,827

DATED : February 12, 1980

INVENTOR(S) : Dieter Regler et al.

It is certified that error appears in the above-identified patent and that said Letters Patent are hereby corrected as shown below:

Column 1, line 31, delete "by".

Signed and Sealed this

*First* Day of *July 1980*

[SEAL]

*Attest:*

SIDNEY A. DIAMOND

*Attesting Officer*

*Commissioner of Patents and Trademarks*

UNITED STATES PATENT AND TRADEMARK OFFICE

CERTIFICATE OF CORRECTION

PATENT NO. : 4,187,827

DATED : Februsry 12, 1980

INVENTOR(S) : Dieter Regler et al.

It is certified that error appears in the above—identified patent and that said Letters Patent is hereby corrected as shown below:

Cover page, Identification of Inventors, second inventor, change "Sitrl" to -- Sirtl --.

Signed and Sealed this

*Thirtieth* Day of *September 1980*

[SEAL]

*Attest:*

SIDNEY A. DIAMOND

*Attesting Officer*

*Commissioner of Patents and Trademarks*